United States Patent [19]

Cosentino et al.

[11] Patent Number: 4,510,170

[45] Date of Patent: Apr. 9, 1985

[54] PROCESS AND APPARATUS FOR ELECTROSTATIC COATING OF POORLY CONDUCTIVE OR NON-CONDUCTIVE PRODUCTS

[75] Inventors: Roberto F. Cosentino; Franco Bonapace, both of Milan, Italy

[73] Assignee: Pharmindev Limited, London, England

[21] Appl. No.: 612,295

[22] Filed: May 21, 1984

[30] Foreign Application Priority Data

May 20, 1983 [GB] United Kingdom ..... 8314025

[51] Int. Cl.[3] ..... B05B 5/02; B05D 1/04

[52] U.S. Cl. ..... 427/33; 427/27; 427/212; 118/303; 118/628; 118/629; 118/630; 118/634

[58] Field of Search ..... 427/27, 33, 212, 215; 118/303, 628, 629, 630, 634

[56] References Cited

U.S. PATENT DOCUMENTS

| | | | |
|---|---|---|---|
| 2,594,469 | 4/1952 | Mahoney | 427/212 |
| 2,644,769 | 7/1953 | Robinson | 427/27 |
| 3,198,655 | 8/1965 | Gisiger | 427/212 |
| 4,209,550 | 6/1980 | Hagenbach et al. | 427/27 |

FOREIGN PATENT DOCUMENTS 85149 10/1983 European Pat. Off. .

*Primary Examiner*—Richard Bueker

*Attorney, Agent, or Firm*—Cushman, Darby & Cushman

[57] ABSTRACT

In the electrostatic application of a coating material on to a product to be coated, the product leaves a supply hopper over a tube enlargement and falls freely in a chamber in the form of a tubular curtain. The tubular curtain falls around a central, elongate, vertical corona discharge electrode so that a high voltage electrostatic charge of one sign is applied to the falling curtain of the product. Coating material is sprayed on to the product by atomizers in the chamber. A high voltage electrostatic charge of opposite sign is applied to the coating material by way of the atomizers.

16 Claims, 4 Drawing Figures

PROCESS AND APPARATUS FOR ELECTROSTATIC COATING OF POORLY CONDUCTIVE OR NON-CONDUCTIVE PRODUCTS

FIELD OF THE INVENTION

This invention relates to a process and apparatus for electrostatic coating of poorly conductive or non-conductive products, for example, pellets, seeds and powders.

The process and apparatus is useful for example for processing simple or pelletized sugar-beet seeds and other types of seeds, crystalline or small grain substances for example and pharmaceutical products.

DESCRIPTION OF THE PRIOR ART

A process and apparatus for electrostatic application of liquids or powders on substances or objects is already known and described in European Patent Application No. 82111001.2.

In this prior process and apparatus, however, non-conductive products as mentioned above, for instance many chemicals, pharmaceutical products and natural or pelletized seeds, cannot be quickly charged by induction.

SUMMARY OF THE INVENTION

The process and apparatus of the present invention is intended to solve this problem, being based on the extension of the electrostatic induction of the product to be coated. According to this invention there is provided a process for electrostatic application of a coating material on a product to be coated, in which the product is caused to descend in free fall in the form of a circular curtain, characterised in that (i) a thin cylindrical curtain of the product to be coated is caused to descend in free fall around a centrally disposed, elongate, vertical corona discharge electrode (6) so as to apply a high voltage electrostatic charge of one sign to the product to be coated, and (ii) coating material is applied to the outer periphery of the falling thin cylindrical curtain, the coating material having applied to it a high voltage electrostatic charge of opposite sign.

The invention also includes apparatus for electrostatic application of a coating material on a product to be coated, comprising a feeding device from which the product is caused to descend within a chamber in free fall in the form of a circular curtain, characterised in that the apparatus includes a device (5A) to form a thin cylindrical curtain of the product to be coated; a chamber (2); an elongate, vertical, corona discharge electrode (6) disposed centrally within the chamber (2), around which electrode (6) the cylindrical curtain falls freely and receives from the electrode (6) a high voltage electrostatic charge of one sign; spraying devices (A1 to A6) mounted by the chamber (2) for directing coating material inwardly on to the outer periphery of the curtain; and means connected to the spraying devices (A1 to A6) for applying to the coating material a high voltage electrostatic charge of opposite sign. The high voltage is of the order of 10 to 90 kV, so as to develop a corona effect discharge.

BRIEF DESCRIPTION OF THE DRAWINGS

An embodiment of the invention will now be described by way of example, with reference to the accompanying drawings, which are purely diagrammatic, and in which.

DESCRIPTION OF THE PREFERRED EMBODIMENT

Figure 1:
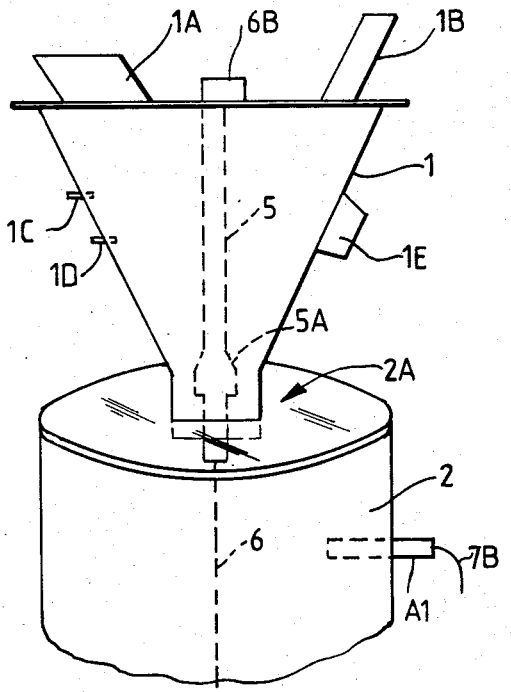
FIG. 1 is a side view showing a hopper in schematic vertical section and below it the upper part of a spraying chamber, seen in a schematic perspective view.

Referring to the drawings, a feed hopper 1 is arranged above a cylindrical spraying chamber 2, of a diameter of for example one meter. The hopper 1 has an inlet 1A for the product to be treated and a powder suction duct 1B. Also the hopper 1 has spaced level probes 1C and 1D and a vibrator 1E.

Six electrostatic atomizers A1 to A6 (FIGS. 2 and 4) are arranged in the manner of the winders of a screw staircase, i.e. they are mounted helically by the wall of the chamber 2 and circumferentially, angularly spaced 60 degrees from one another, and with a height displacement of 150 to 500 mm. from one another, according to the particular features of the product to be coated. Atomizer A1 is also seen in FIG. 1. Each atomizer is energised by a wire 7B.

Each atomizer is mounted by a bracket 7 and a ball joint 7A (FIG. 2), allowing regulation of the distance of each atomizer from the product being treated and also its angular disposition with respect to the falling curtain of the product, in addition to the width of the sprayed area of the chamber 2 down through which the product is falling freely. Each atomizer A1 to A6 produces an electrostatic effect with an enveloping action on the corresponding portion of the cylindrical curtain of the falling product, inside which there is maintained a corona effect discharge of a sign opposite to that of the atomizers.

Figure 2:
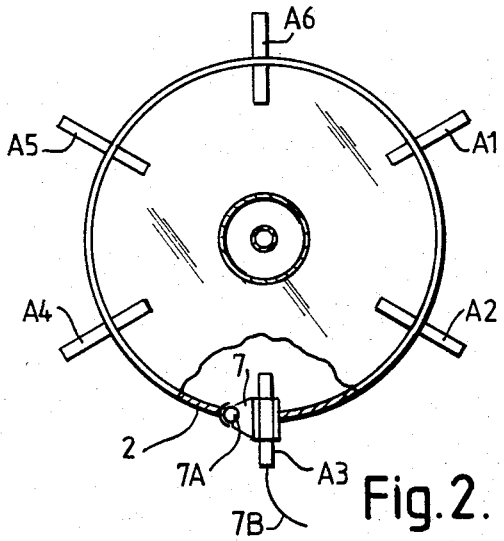
FIG. 2 is a schematic top plan view of the spraying chamber.

Each atomizing nozzle A1 to A6 is mounted in the wall of the chamber 2 by the bracket 7 (see nozzle A3 in FIG. 2). The nozzle is slidably carried by the bracket 7 and the latter is mounted by the ball joint 7A in the wall of the chamber 2. In this way the nozzles can be angularly adjusted in relation to the elongate electrode 6, and can also be adjustably movable inwardly and outwardly in relation to the elongate electrode 6 and the falling cylindrical curtain of product around it in the chamber 2.

The use of the six atomizers to apply the coating material and the relatively low delivery of the atomizers, causes a reduced pressure on the atomized surface, so as to hinder the overspray phenomenon and at the same time to avoid deformation of the fall path of the product being treated.

Further, the use of at least six helically arranged atomizers, to avoid repulsion phenomena, provides a uniform coating of all the product being processed. The charge on the product is obtained by an elongate electrode comprising an endless wire 6 given a slow vertical motion, and passing through a self-cleaning device 3A so as to avoid accumulation of powder on the electrode, which could reduce effectiveness of the corona discharge during continuous operation.

Product to be processed or treated is fed into the hopper 1 by the inlet 1A and its level in the hopper is sensed by the probes 1C and 1D. Movement of the product down through the hopper can be assisted by vibration of the hopper by the vibrator 1E. Extending centrally, vertically through the hopper is a column-like protective sheath 5 having an enlargement 5A down over which the product passes, to fall into the spraying chamber 1 in the form of a very thin, generally cylindrical curtain of free falling product.

Figure 3:
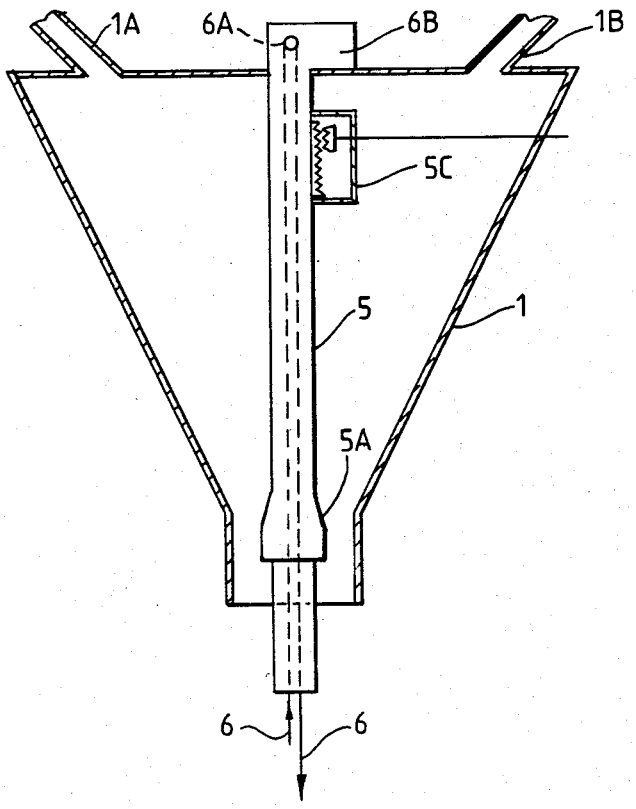
FIG. 3 is a schematic vertical section of the hopper showing a wire electrode within a sheath.
Figure 4:
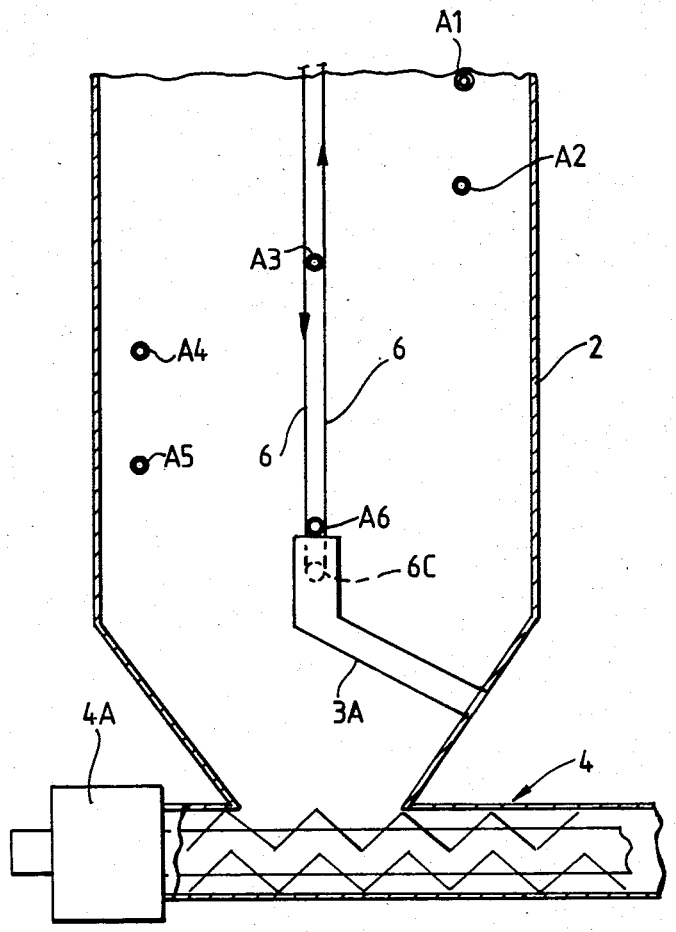
FIG. 4 is a schematic vertical section of the lower part of the spraying chamber, with a discharge screw shown below it.

Within the sheath 5 is a corona discharge electrode in the form of a wire 6 which passes over a driving device 6A at the top (FIG. 3), including a motor 6B and over a return pulley 6C at the bottom of the chamber 2 (FIG. 4). It will thus be understood that the corona discharge wire 6 passes up and down in the centre of the spraying chamber 2 in the form of an endless loop and is surrounded by the helically arranged atomizers.

The coated product is removed from the lower end of the chamber 2 by a discharge screw device 4 and operated by a variable speed motor 4A (FIG. 4).

The apparatus may be completely sealed so as to allow atomization of fungicides, pesticides and toxic substances, or the use of solvents in an atmosphere of nitrogen or precombustion air.

Each atomizer may be fed by a peristaltic pump (not shown) with an electrically insulated head, so as to allow use of aqueous solutions and of poorly conductive or non-conductive liquids, or fed by a pressurized tank.

The outlet from the hopper 1 may be regulated by a spacer cone (not shown) producing uniform flow of the falling product. The hopper has the probes 1C and 1D and the vibrator 1E to keep the level of the product constant and to eliminate the risk of bridge formation by a product of low flowability.

A lid or closure disc 2A in the form of a transparent plastics plate is arranged at the top of the spray chamber 2 and may act also as a support base for the hopper 1; it avoids possible leakage of powdery material or steam, and allows the coating process to be checked during operation of the apparatus.

The process and apparatus of the invention allows accurate continuous addition of liquids or powders to poorly conductive or non-conductive pellets or granules and to those products which cannot be properly or economically coated by means of known electrostatic apparatus (for example, that disclosed in the above mentioned European Patent Application), and with an accuracy that cannot be obtained with traditional mechanical systems.

Further, the process and apparatus of the invention allows, where required, application of high percentages of toxic chemical substances on a product to be coated, with a high degree of safety for the operators, as well as of fat and thermolabile substances and animal feed pellets. This is due to the attraction created between the product to be coated and the atomized material, mutually at a high potential difference, and avoiding formation of mist or emission of powder to the environment.

Start of the apparatus and its output is related to actuation and flow of the atomizers so as to provide operative synchronism.

The atomization chamber 2, having a diameter of about 1 meter, may be wholly of steel or may be internally lined with a non-conductive plastics material.

Atomizers, brackets, spacers, the sheath for the electrode wire and other parts of the apparatus in contact with or close to the electrodes are preferably made of non-conductive Nylatron or other non-conductive material of similar characteristics.

Thus the process and apparatus of this invention provides for continuous electrostatic induction of the product being processed, the induction being caused by a central vertical electrode and a set of atomizers arranged at different heights around the electrode, and preferably in a helical pattern.

We claim:

1. A process for the electrostatic application of a coating material on a product to be coated, comprising the steps of:

(a) causing the product to descend in free fall in the form of a thin cylindrical curtain around an elongate, vertical, centrally disposed, corona discharge electrode;

(b) applying a current of high voltage to said elongate vertical electrode so as to apply a high voltage electrostatic charge of one sign to said cylindrical curtain;

(c) applying coating material to the outer periphery of said cylindrical curtain, said coating material having applied to it a high voltage electrostatic charge of opposite sign to said one sign.

2. A process according to claim 1 wherein said elongate electrode is a wire movable in a vertical direction whilst said product to be coated falls around it.

3. A process according to claim 2 wherein said wire has a vertically upwardly moving component and a vertically downwardly moving component.

4. A process according to claim 1 wherein said coating material is applied to the outer periphery of said cylindrical curtain from a series of circumferentially spaced spraying devices.

5. A process according to claim 4 wherein said series of spraying devices comprises equidistantly circumferentially spaced atomizing nozzles disposed at different heights around said elongate electrode.

6. A process according to claim 5 wherein said atomizing nozzles are are disposed in a helical arrangement around said elongate electrode.

7. An apparatus for the electrostatic application of a coating material on a product to be coated, comprising:

(a) a feed device having an upper and lower end for receiving said product;

(b) means associated with said feed device at said lower end to cause said material to fall in the form of a thin cylindrical curtain;

(c) a chamber below said feed device;

(d) an elongate, vertical, corona discharge electrode disposed centrally within said chamber such that said curtain falls freely around said electrode and within said chamber;

(e) means to apply a high voltage current to said electrode whereby said curtain within said chamber receives a high voltage electrostatic charge of one sign;

(f) spraying devices mounted by said chamber for directing said material on to the outer periphery of said cylindrical curtain within said chamber; and (g) means for applying a high voltage current to said spraying devices whereby said coating material receives a high voltage electrostatic charge of a sign opposite to said one sign.

8. An apparatus according to claim 7 wherein said elongate electrode is a wire movable in a vertical direction.

9. An apparatus according to claim 8 wherein said wire has a vertically upwardly movable component and a vertically downwardly movable component.

10. An apparatus according to claim 7 wherein said spraying devices are spaced apart circumferentially about said chamber.

11. An apparatus according to claim 10 wherein said spraying devices are atomizing nozzles disposed at different heights in a helical arrangement around said elongate electrode.

12. An apparatus according to claim 11 wherein said atomizing nozzles are mounted by the chamber so as to be adjustably movable inwardly or outwardly in relation to said elongate electrode.

13. An apparatus according to claim 11 wherein said atomizing nozzles are mounted by the said chamber so as to be angularly adjustable in relation to said elongate electrode.

14. An apparatus according to claim 7 wherein said elongate electrode extends centrally, vertically through said feed device within a column-like sheath, said electrode extending downwardly out of the lower end of said sheath into said chamber.

15. An apparatus according to claim 14 wherein the vertical position of said sheath within said feed device is adjustable by height regulating means.

16. An apparatus according to claim 7 wherein the lower end of said elongate electrode is disposed in a suction duct for removal of residual coating material from the electrode.

* * * * *